US007735498B2

(12) United States Patent
You

(10) Patent No.: US 7,735,498 B2
(45) Date of Patent: Jun. 15, 2010

(54) UMBRELLA WITH MECHANISM FOR AUTOMATIC OPENING OR CLOSING

(76) Inventor: Ching-Chuan You, 4FL. No. 27, Lane 160, Hsin Sheng S. Rd., Sec. 1, P.O. Box 1-79, Taipei (TW) 100

( * ) Notice: Subject to any disclaimer, the term of this patent is extended or adjusted under 35 U.S.C. 154(b) by 201 days.

(21) Appl. No.: 12/155,145

(22) Filed: May 30, 2008

(65) Prior Publication Data

US 2009/0293925 A1 Dec. 3, 2009

(51) Int. Cl.
*A45B 25/16* (2006.01)

(52) U.S. Cl. ..... 135/24

(58) Field of Classification Search ..... 135/15.1, 135/22, 24

See application file for complete search history.

(56) References Cited

U.S. PATENT DOCUMENTS 5,141,010 A 8/1992 Muller et al.
7,588,041 B2 * 9/2009 Huang ..... 135/24
2002/0157694 A1 * 10/2002 Chen ..... 135/24
2004/0020523 A1 * 2/2004 Lin et al. ..... 135/24
2004/0200516 A1 * 10/2004 Ko ..... 135/24

* cited by examiner

*Primary Examiner*—David Dunn
*Assistant Examiner*—Noah Chandler Hawk

(57) ABSTRACT

An umbrella includes a control mechanism comprising a hollow cylinder, a control block, a press mechanism, a push member, and an actuation block; a shank assembly comprising a support tube, first and second sliding tubes, and a resilient member; a link assembly comprising a pulley mechanism, a main spring, a rope, and a link; a runner and top assembly comprising a runner having peripheral slots wherein one of the slots is secured to the rope, and a hub secured to the cylindrical section and having peripheral slots; and a rib and stretcher assembly comprising ribs, stretchers, and auxiliary spring and rod combinations. Umbrella can be opened by pressing the push button with the main spring being expanded or closed by pressing the push button again with the auxiliary springs being compressed. After closing the umbrella, the main spring can be compressed by urging against a hard object.

13 Claims, 15 Drawing Sheets

UMBRELLA WITH MECHANISM FOR AUTOMATIC OPENING OR CLOSING

BACKGROUND OF THE INVENTION

1. Field of Invention

The invention relates to umbrellas and more particularly to such an umbrella having a mechanism capable of opening the umbrella by pressing a push button with a main spring being expanded, closing the umbrella by pressing the push button again with stretcher springs being compressed, or after closing the umbrella compressing the main spring by urging a ferrule against, for example, the ground so that the umbrella can be opened again.

2. Description of Related Art

Conventionally, an umbrella can be classified as one having a telescopic shank and one without a telescopic shank. Also, umbrellas having automatic opening feature are commercially available. For umbrellas with telescopic shank having automatic opening feature, its folding sections are short and thus mechanism for effecting same is simple. To the contrast, for umbrellas without telescopic shank having automatic opening or closing feature, its folding sections are long and thus mechanism for effecting same is complicated. Such umbrella is disclosed in U.S. Pat. No. 5,141,010. However, so far as the inventor is aware, the devices shown in the prior art patents have had no market acceptance.

Typically, a main spring is provided in the shank so that a release of stored elastic energy by pressing a tab will open the umbrella. A plurality of stretcher springs are provided each between the stretcher and the rib so that pressing the stretcher springs will collapse the umbrella. That is, the opening is done by the elastic force of the main spring overcomes the resistance of the stretcher springs and the closing is done by the elastic force of the stretcher springs overcomes the resistance of the main spring which is, however, not feasible in terms of existing technology.

For overcoming the bottle neck, the inventor seeks a solution of making the main spring to be expansible in two steps in which in the first step the elastic force of the main spring is released to open the umbrella and in the second step the elastic force of the main spring is released as an complementary force of the elastic force of the stretcher springs so that the umbrella can be closed easily. Further, the release of the elastic force of the main spring is step by step in a control manner so as to be stable. Furthermore, the elastic force of the main spring is completely released in the umbrella closing step. Thus, a spring restoring step is required so that the main spring can be returned to a compressed state by storing elastic force for a future two-step expansion. This is the novel feature of the invention in the development of mechanism of automatically opening an umbrella without a telescopic shank. It is also known that umbrellas without a telescopic shank as widely used by people. Thus, continuing improvements in the exploitation of an umbrella without a telescopic shank having a novel automatic opening mechanism are constantly being sought.

SUMMARY OF THE INVENTION

It is therefore one object of the invention to provide an umbrella having a mechanism having a mechanism capable of opening the umbrella by pressing a push button with a main spring being expanded, closing the umbrella by pressing the push button again with stretcher springs being compressed, or after closing the umbrella compressing the main spring by urging a ferrule against, for example, the ground so that the umbrella can be opened again.

To achieve the above and other objects, the invention provides an umbrella comprising a control mechanism comprising a hollow cylinder, a control block, a press mechanism, a U-shaped push member, and a T-shaped actuation block wherein the cylinder comprises a surface opening, the control block is disposed in the cylinder and comprises an axial space and a surface opening communicating with the space, the push member is disposed in the space and biased by a spring to be aligned with the opening, the push member comprising an inwardly projected first protrusion with the spring put thereon and an outwardly projected second protrusion opposite the first protrusion, and the actuation block is biased by a spring thereunder; a shank assembly comprising a support tube, a first sliding tube, a second sliding tube, and a resilient member wherein the support tube comprises a cylindrical section and a rear, lower opening, the first sliding tube comprises a main section slidably fitted in the cylindrical section and secured to the control block, the main section comprising a window, the second sliding tube is slidably fitted in the main section and comprises a window, and the resilient member is disposed in the rear of the second sliding tube; a link assembly comprises a pulley mechanism, a spring, a rope, and a link wherein the pulley mechanism comprises an upper seat with first and second sheaves, the upper seat being secured to the cylindrical section, a lower seat with a third sheave, the rope passes around the first, second, and third sheaves, to interconnect the upper and lower seats, the spring is put on the cylindrical section and biased between the lower seat and the cylindrical section, and the link comprises a rod connected to the lower seat, and a head formed at one end of the rod, the head being urged by the resilient member to lock in the window; a runner and top assembly comprising a lower runner slidably disposed on the cylindrical section and comprising a plurality of slots equally spaced around wherein one of the slots is secured to the rope, and an upper hub secured to an upper portion of the cylindrical section and comprising a plurality of slots equally spaced around; and a rib and stretcher assembly comprising a plurality of ribs having one end pivotably secured to the slit, a plurality of stretchers having one end pivotably secured to a first intermediate portion of the rib and the other end pivotably secured to the slot, and a plurality of springs biased between the other end of the stretcher and a second intermediate portion of the rib.

The above and other objects, features and advantages of the invention will become apparent from the following detailed description taken with the accompanying drawings.

DETAILED DESCRIPTION OF THE INVENTION

Figure 1:
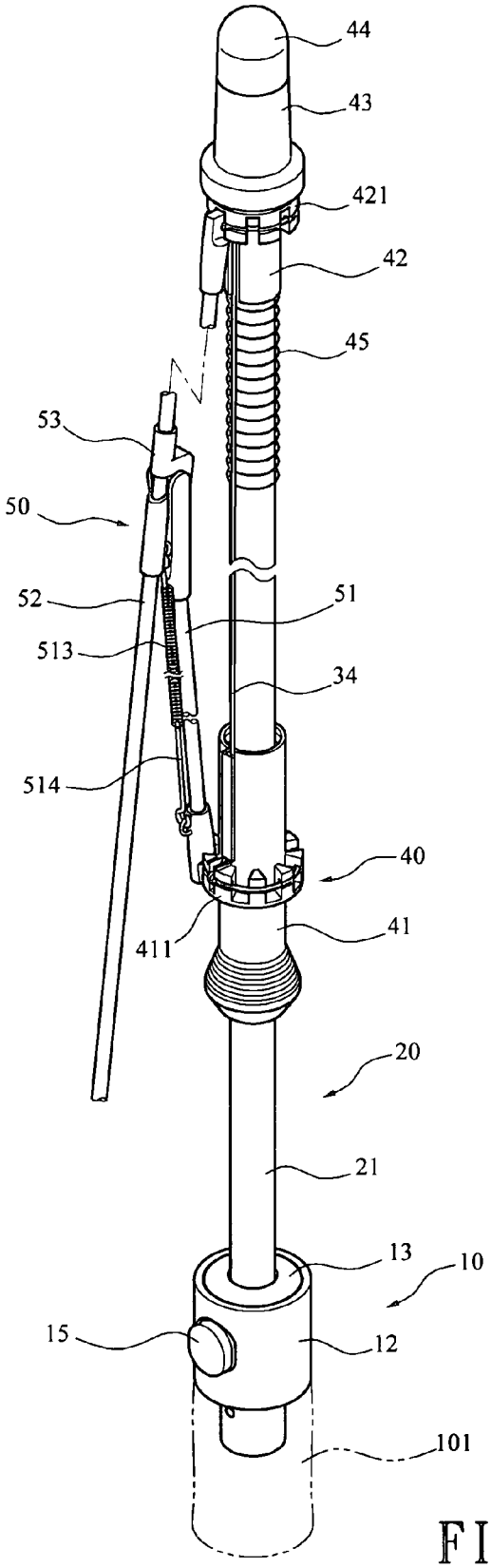
FIG. 1 is a perspective view of shank, stretcher, and rib of a preferred embodiment of umbrella according to the invention, in a closed condition.
Figure 2:
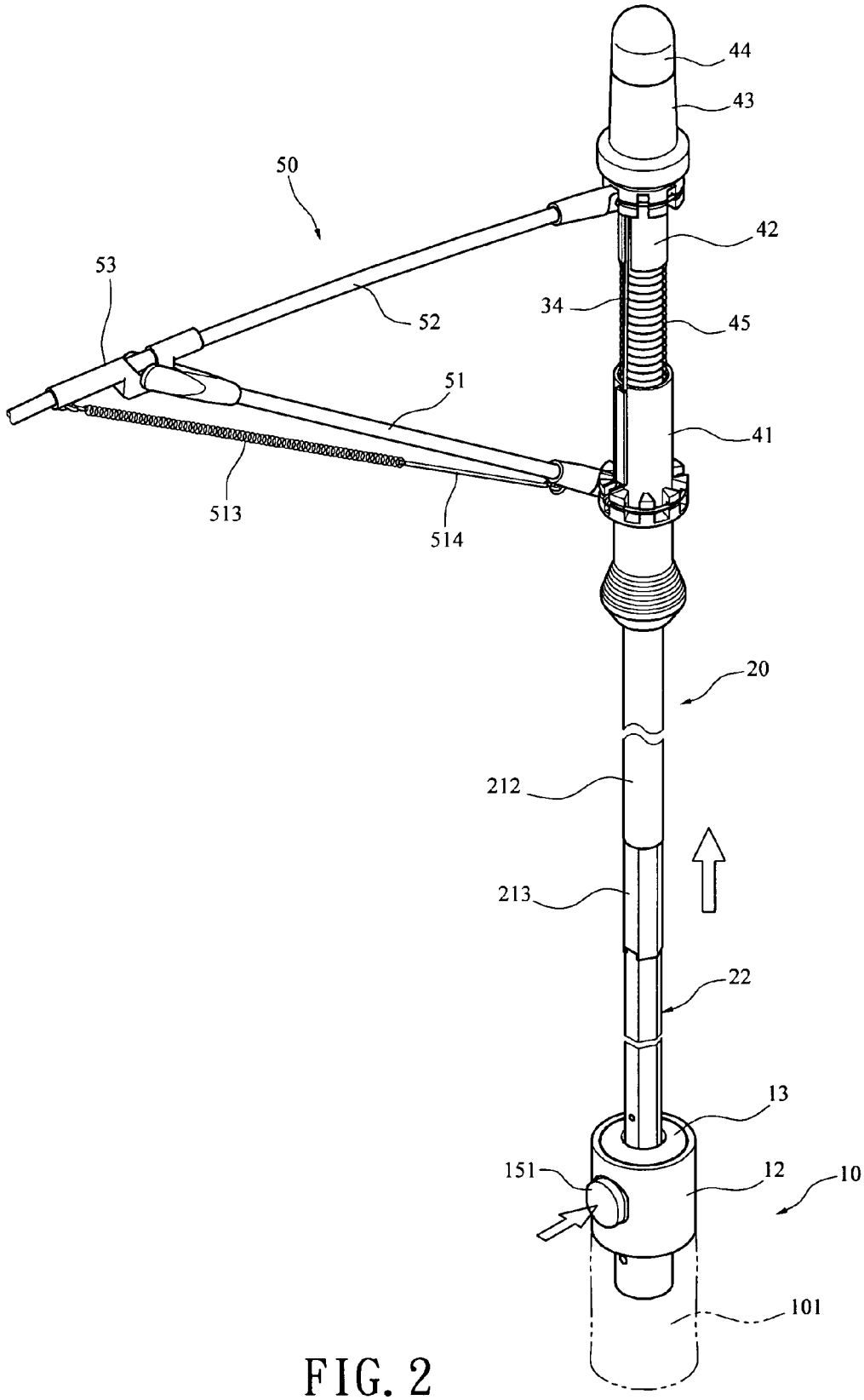
FIG. 2 is a view similar to FIG. 1, in an open condition.
Figure 3:
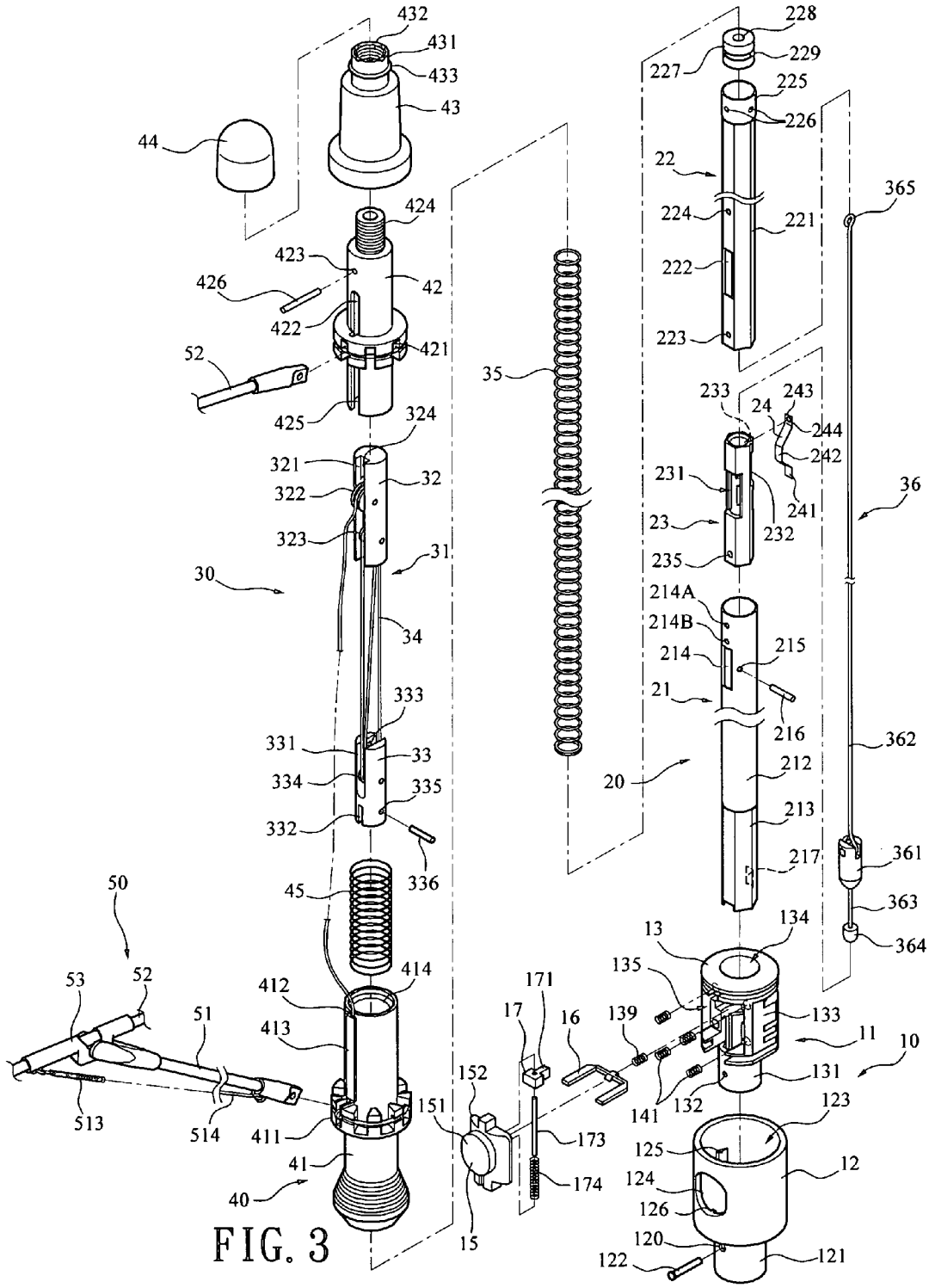
FIG. 3 is an exploded view of the components of umbrella shown in FIG. 1.
Figure 4:
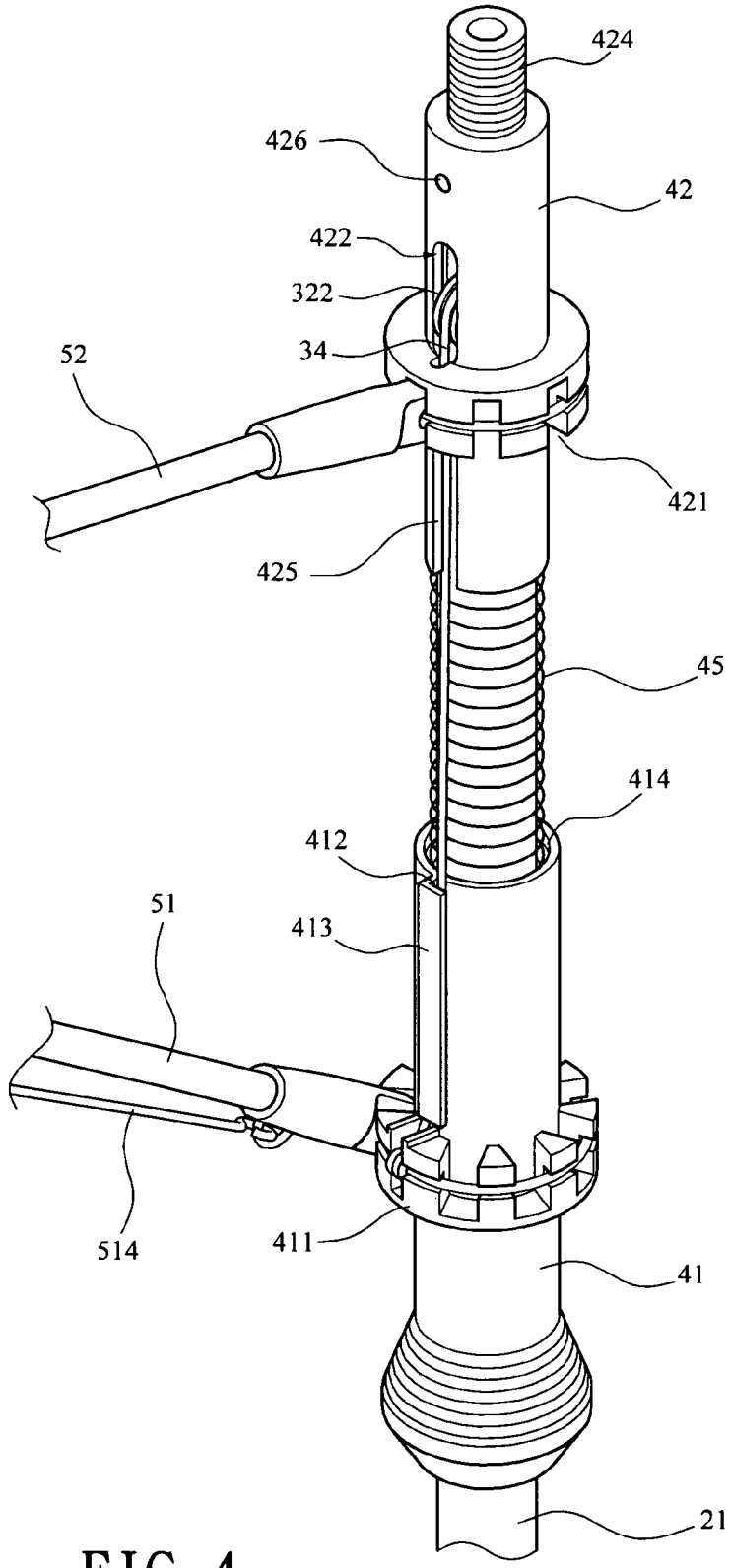
FIG. 4 is an enlarged view of the upper portion of FIG. 2.
Figure 5:
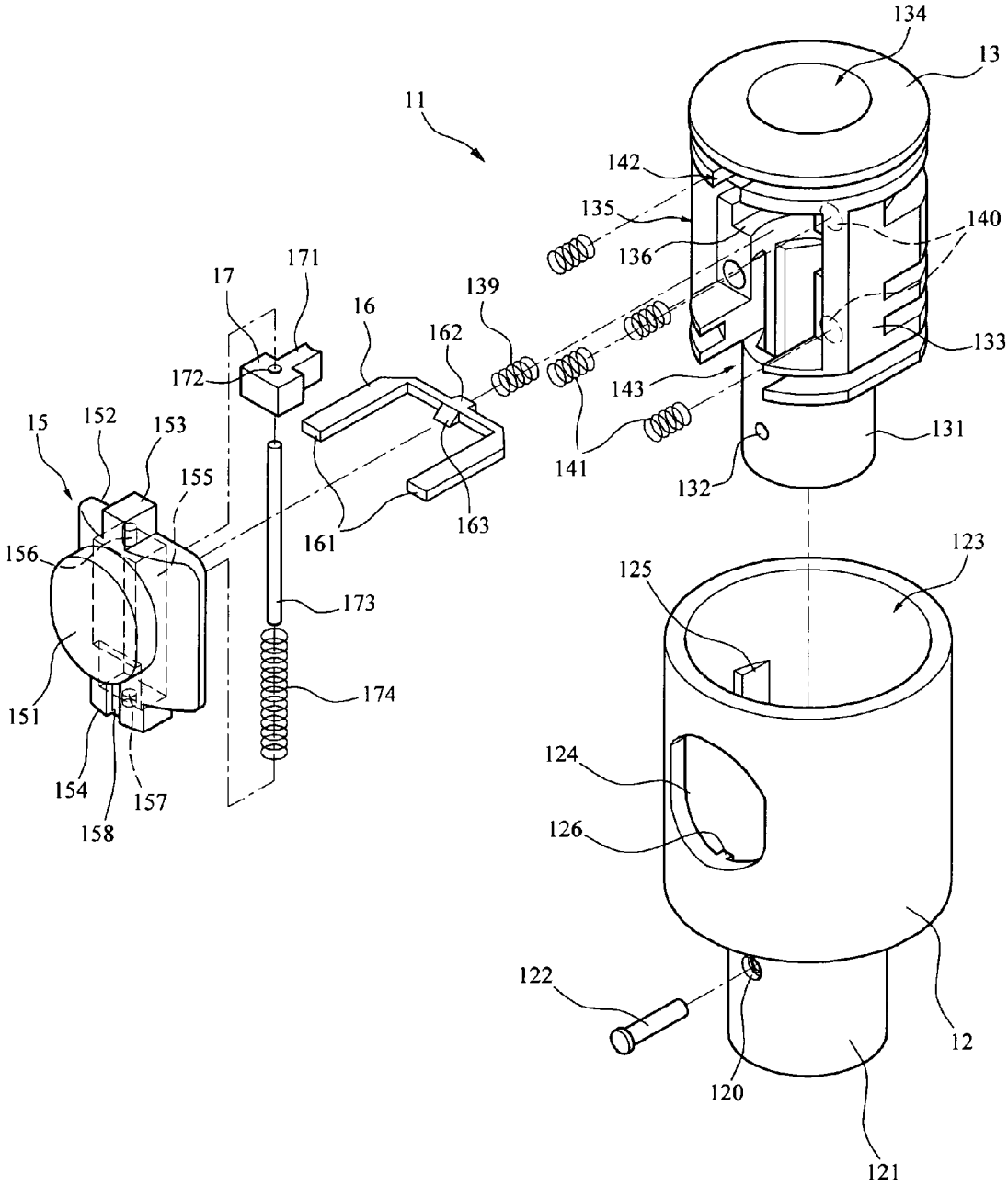
FIG. 5 is an enlarged view of the right lower portion of FIG. 3.

Referring to FIGS. 1 to 15C, an umbrella in accordance with a preferred embodiment of the invention is shown. The umbrella comprises a handle and actuation assembly 10, a shank assembly 20, a link assembly 30, a runner and top assembly 40, and a rib and stretcher assembly 50. Each component is discussed in detail below.

The handle and actuation assembly 10 comprises a handle 101, a control mechanism 11 provided in the handle 101 and including a hollow cylinder 12, a control block 13, and a press mechanism 15. The cylinder 12 is provided on the top of the handle 101 and includes a downward extension 121 of reduced diameter, a hole 120 through the extension 121, a space 123 defined by the cylinder 12, an opening 124 on the periphery of the cylinder 12, a guide projection 126 on the inner surface of the cylinder 12 and proximate the bottom of the opening 124, and two opposite raised guiding wedges 125 on the inner surface of the cylinder 12 with the guide projection 126 disposed therebetween.

The hollow, cylindrical control block 13 comprises a downward extension 131 of reduced diameter with a blind bottom, a hole 132 through the extension 131, two opposite flats 133 on the outer surface of the control block 13, an axial space 134 defined by the control block 13, a lower space 134A in communication with the space 134 defined by the extension 131, and an opening 135 on the periphery of the control block 13 and being in communication with the space 134.

A U-shaped groove 136 is provided to have one end terminated inside the control block 13 by passing the space 134 and the other end terminated at the opening 135. A plurality of receptacles 140 are provided on both sides of the opening 135 in the control block 13. A cavity 137 is provided on the center of the blind end of the groove 136. A spring 139 is provided in the cavity 137 and a plurality of springs 141 are provided in the receptacles 140. A recess 142 is provided on the top of the opening 135 and a recess 143 is provided on the bottom of the opening 135.

A U-shaped push member 16 is provided in the groove 136 and comprises two arms 161, an inwardly projected first protrusion 162 on the center of its interconnection portion, and an outwardly projected second protrusion 163 of triangular section on the center of its interconnection portion opposite the first protrusion 162. The spring 139 is put on the first protrusion 162 and is anchored in the cavity 137.

The press mechanism 15 is slidably provided in the opening 135 and comprises an exposed, oval push button 151, a rectangular press plate 152, a top riser 153 loosely provided in the top recess 142, a bottom riser 154 loosely provided in the bottom recess 143, a central, longitudinal trough 158 formed on the bottom riser 154 with the guide projection 126 loosely disposed therein, a well 155 provided on the rear surface of the press plate 152, and first and second apertures 156, 157 provided on the top and bottom edges of the well 155 respectively.

A T-shaped actuation block 17 is provided in the well 155 and comprises a long part 171 having an arcuate end and a longitudinal hole 172 through the short part of the actuation block 17. A spring 174 put on a pin 173 which has a lower end fitted in the second aperture 157 and an upper fitted in the first aperture 156 after passing the hole 172. Hence, the spring 174 is biased between the bottom edge of the well 155 and the bottom of the actuation block 17.

In assembly, the press mechanism 15 is disposed in the opening 135. Next, place the control block 13 in the space 123 of the cylinder 12 with the push button 151 being pushed outward by the elastic force of the spring 141 to dispose in the opening 124. Also, the push member 16 is pushed outward by the spring 139 to urge against the back of the press plate 152. The guiding wedges 125 are engaged with the flats 133 and are confined by the projecting top end bottom edges of the flat 133. A pin 122 inserts through the hole 120 and the hole 132. Further, both ends of the pin 122 are hammered into two enlarged heads so as to fasten the extensions 121, 131 together, i.e., the cylinder 12 and the control block 13 secured together.

The shank assembly 20 comprises a support tube 21 of small diameter, a first sliding tube 22 of medium diameter, and a second sliding tube 23 of large diameter. The support tube 21 comprises an upper cylindrical section 212 of circular section, a rectangular window 214 on the cylindrical section 212 proximate its top, upper and lower holes 214A, 214B provided between the window 214 and the top end of the cylindrical section 212, and a hole 215 on either side of the window 215; and a lower section 213 shorter than the cylindrical section 212, the lower section 213 shaped to have multiple side surfaces and having a rear opening 217.

The first sliding tube 22 comprises a main section 221 of multiple side surfaces and adapted to have a portion slidably fitted in the lower section 213. The main section 221 comprises a rectangular window 222 on one side surface, a hole 224 provided above the window 222, and a hole 223 provided below the window 222. A sleeve 225 of circular section is provided on the top end of the main section 221. Two spaced protuberances 226 are formed on the inner surface of the sleeve 225. A plug 227 of circular section is provided to have an axial channel 228 and an annular trough 229. The protuberances 226 are urged against the troughs 229 for fastening the plug 227 in the sleeve 225.

The second sliding tube 23 is shaped to have multiple side surfaces so as to slidably fit in the first sliding tube 22. The second sliding tube 23 comprises a rectangular first window 231 aligned with the window 222, a rectangular second window 232 opposite the first window 231 but not aligned, a protrusion 233 above the top edge of the second window 232, and a lower hole 235.

A bent resilient member 24 includes an upper flat 243 having a hole 244 put on the protrusion 233, a lower flat 241 urged against a portion of the second sliding tube 23 below the second window 232, and a curved interconnection 242 projecting through the second window 232 into the second sliding tube 23.

In assembling the shank assembly 20, the second sliding tube 23 is inserted into the lower portion of the main section 221 of the first sliding tube 22 to align the window 231 with the window 222. Also, the lower flat 241 of the resilient member 24 is clamped between the second sliding tube 23 and the main section 221 of the first sliding tube 22. The main section 221 of the first sliding tube 22 inserts through the space 134 and the space 134A to be secured by the pin 122 inserting through the holes 223, 235 (see FIGS. 7, 10). The cylindrical section 212 of the support tube 21 is put on the main section 221 of the first sliding tube 22 with the lower section 213 of the support tube 21 disposed in the space 134. Also, the second protrusion 163 projects into the opening 217 for fastening. As a result, the main section 221 of the first sliding tube 22 is fixed, the cylindrical section 212 of the support tube 21 is slidable, and the end of the long part 171 of the actuation block 17 is urged against the surface of the lower section 213 of the support tube 21.

The link assembly 30 is provided in the shank assembly 20 and comprises a pulley mechanism 31, a spring 35, and a link 36. The pulley mechanism 31 comprises an upper seat 32 of cylindrical shape having a longitudinal groove 321, upper and lower sheaves 322, 323 provided in the groove 321, and a through hole 324 proximate the top of the groove 321; a lower seat 33 of cylindrical shape including an upper cut 331, a spaced lower cut 332, a weight 333 in the upper cut 331, a sheave 334, a hole 335 through the lower cut 332, and a pin 336 inserted through the hole 335; and a rope 34 having one end secured to the weight 333 and passing around the sheaves 323, 334, 332 so as to interconnect the upper and lower seats 32, 33.

A pin (not shown) inserts through the holes 324, 214B to secure the upper seat 32 and the cylindrical section 212 of the support tube 21 together. The lower seat 33 is provided in the cylindrical section 212 of the support tube 21 and is adapted to lift or lower relative to the upper seat 32. The spring 35 is provided in the cylindrical section 212 of the support tube 21 and is biased between the plug 227 and the lower seat 33. The link 36 comprises a first rod 362, a hook 365 at the end of the first rod 362 disposed in the lower cut 332 with the pin 336 inserted through the hook 365 so as to secure the link 36 to the lower cut 332, a second rod 363, an enlarged head 364 of bullet head shaped at the end of the second rod 363, and a connecting actuation block 361 interconnecting the first, second rods 362, 363.

Figure 6:
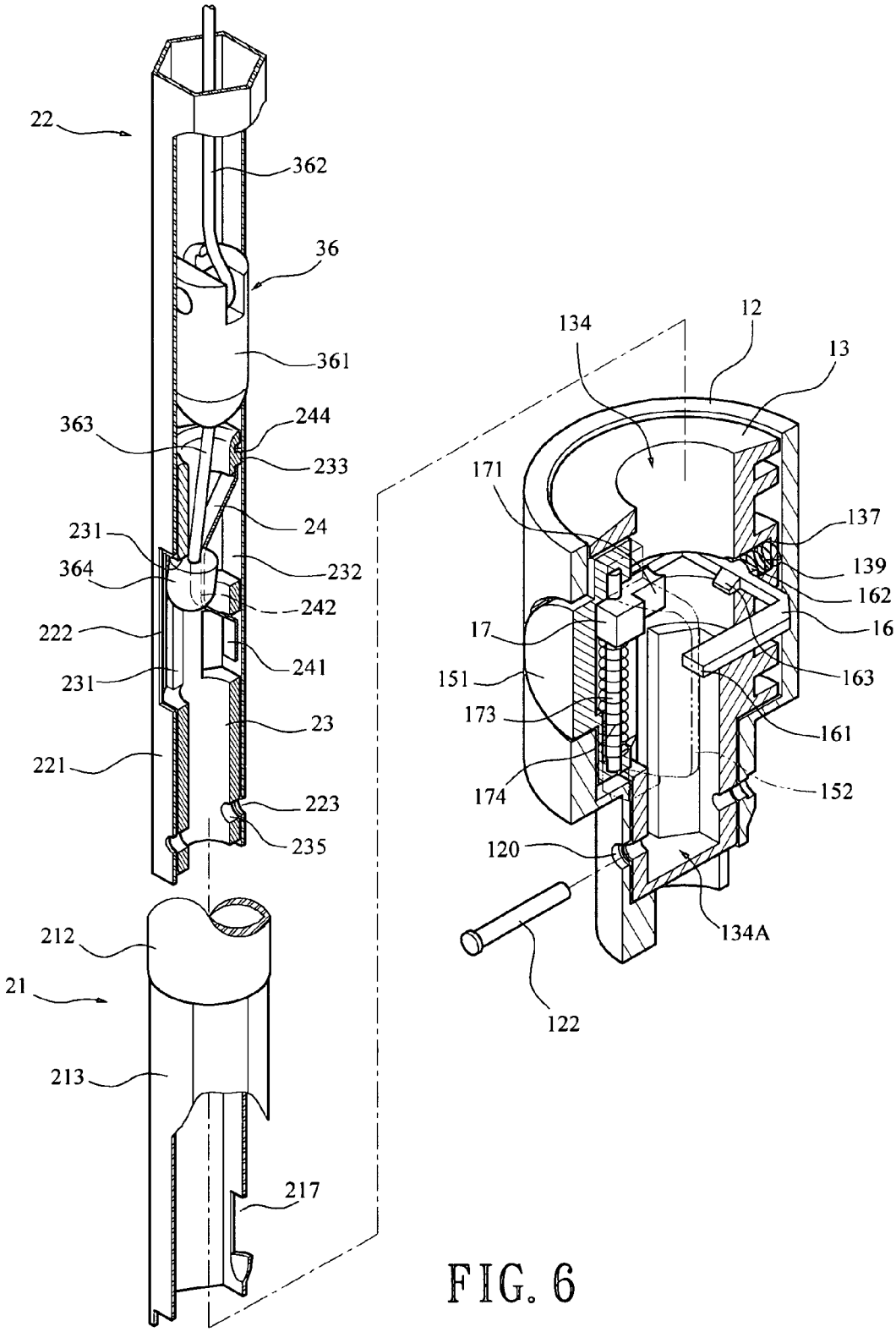
FIG. 6 is a longitudinal sectional view of the components of FIG. 5 being assembled and portions of shank.
Figure 7:
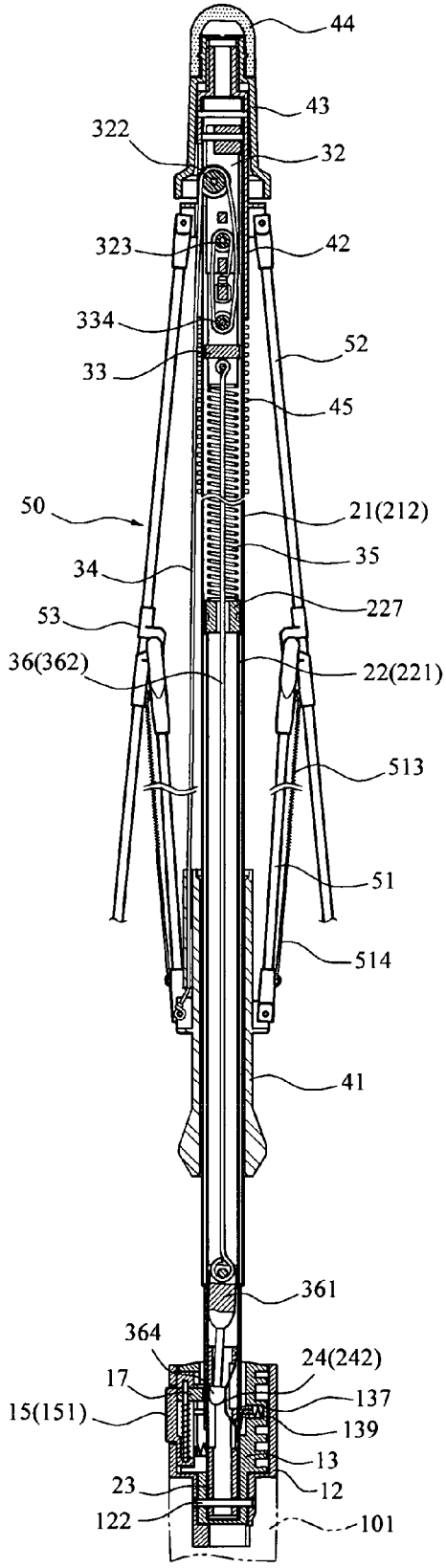
FIG. 7 is a longitudinal sectional view of the frame of the umbrella, in a closed condition.
Figure 7A:
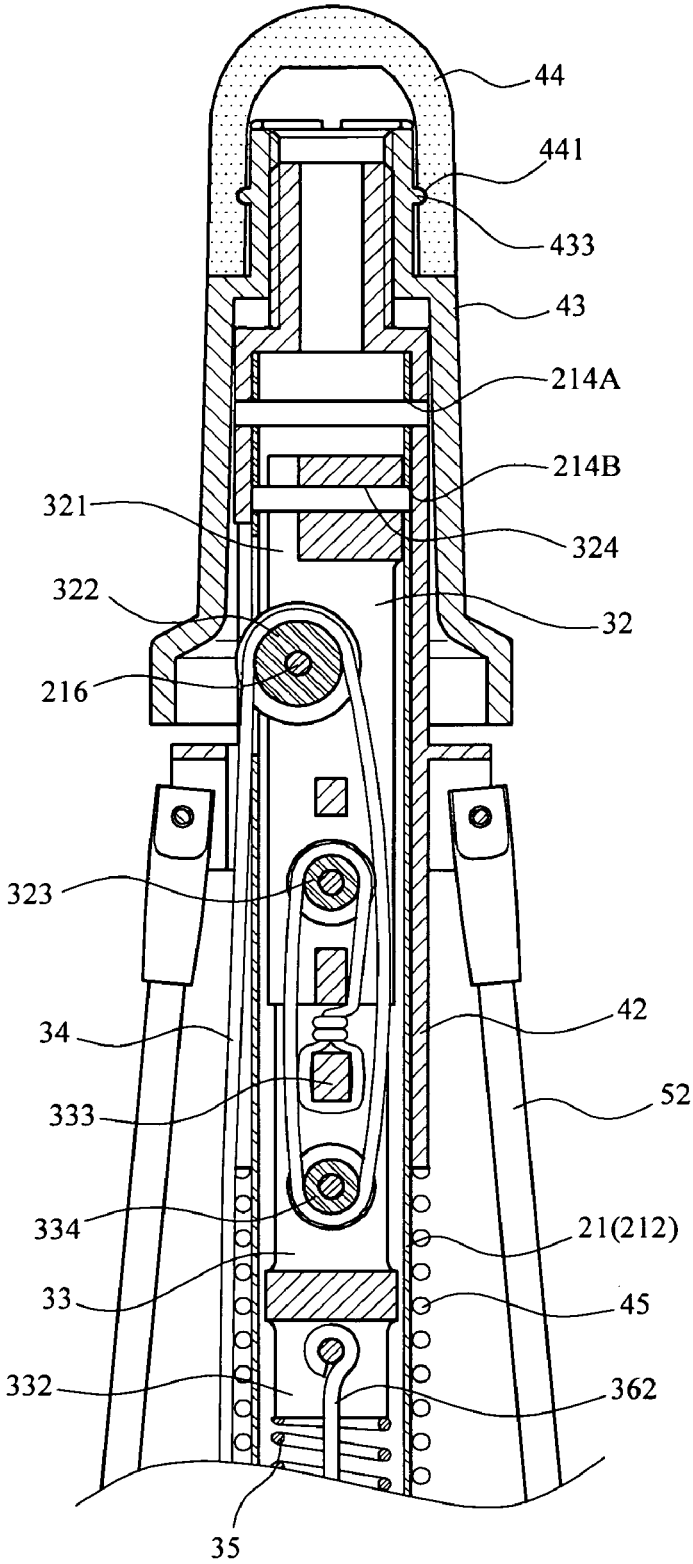
FIG. 7A is an enlarged view of the upper portion of FIG. 7.
Figure 8:
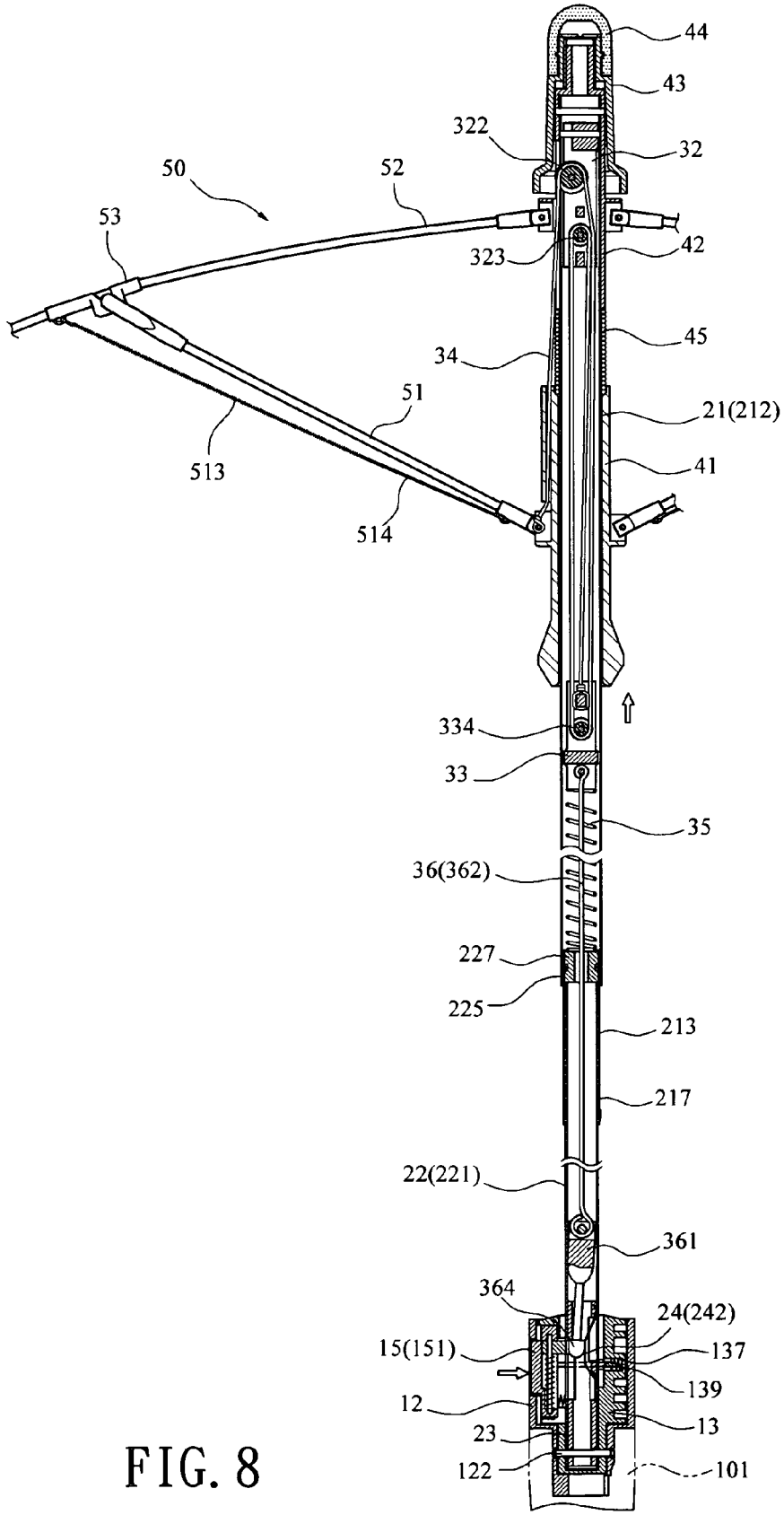
FIG. 8 is a view similar to FIG. 7, in an open condition.
Figure 8A:
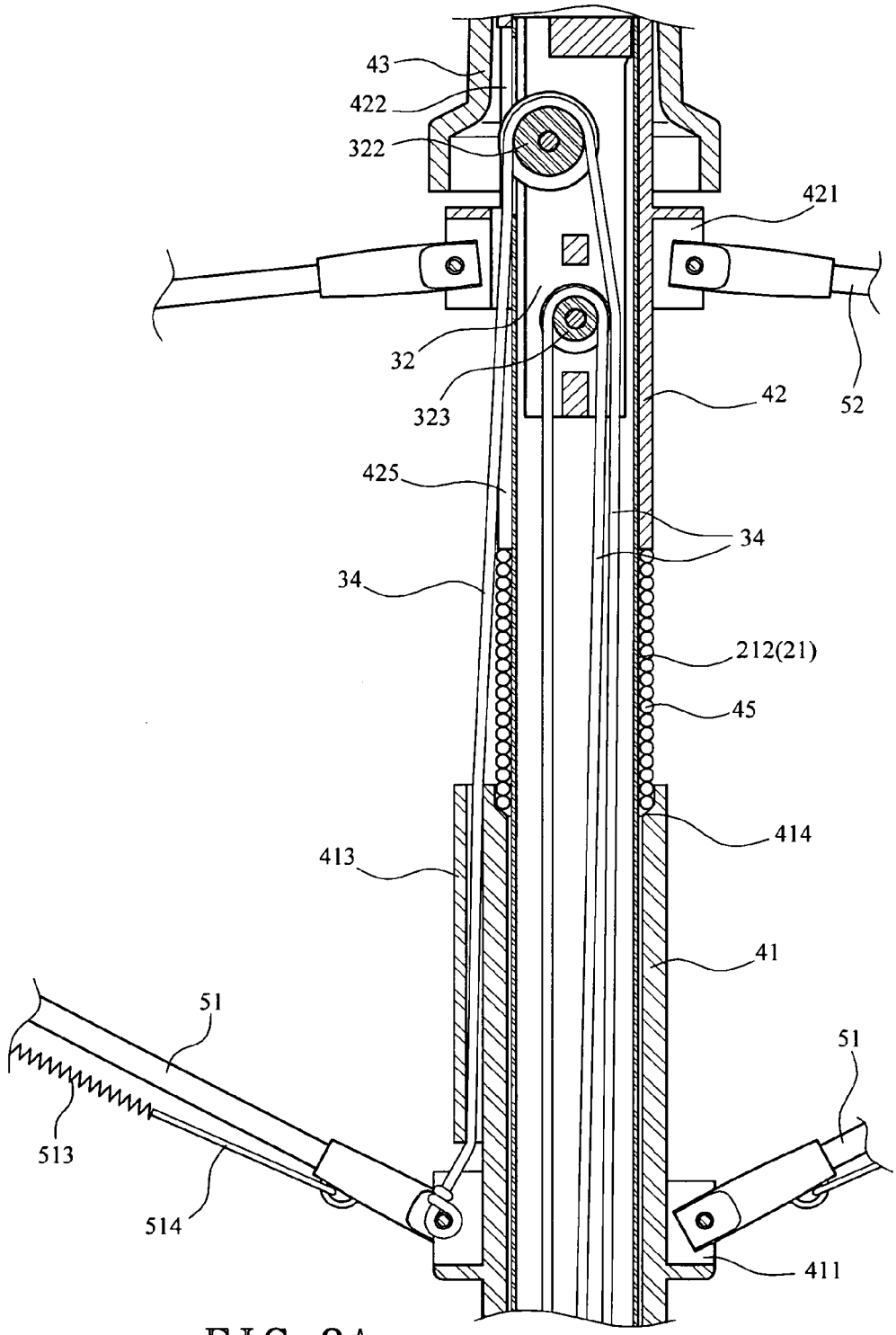
FIG. 8A is an enlarged view of the upper portion of FIG. 8.
Figure 9:
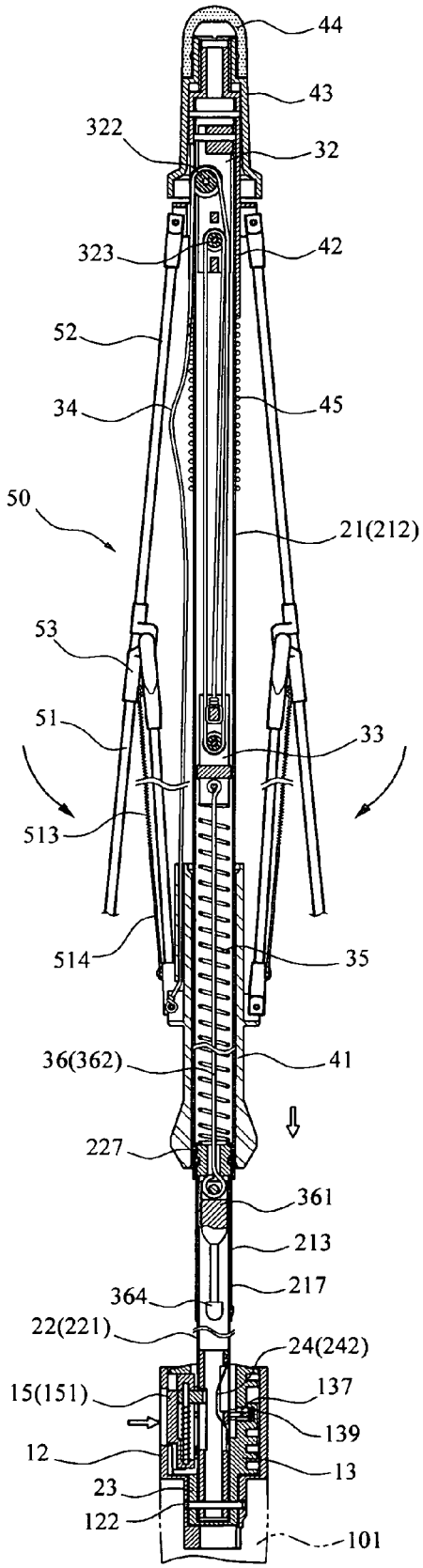
FIG. 9 is a view similar to FIG. 7 where the umbrella is being closed.
Figure 9A:
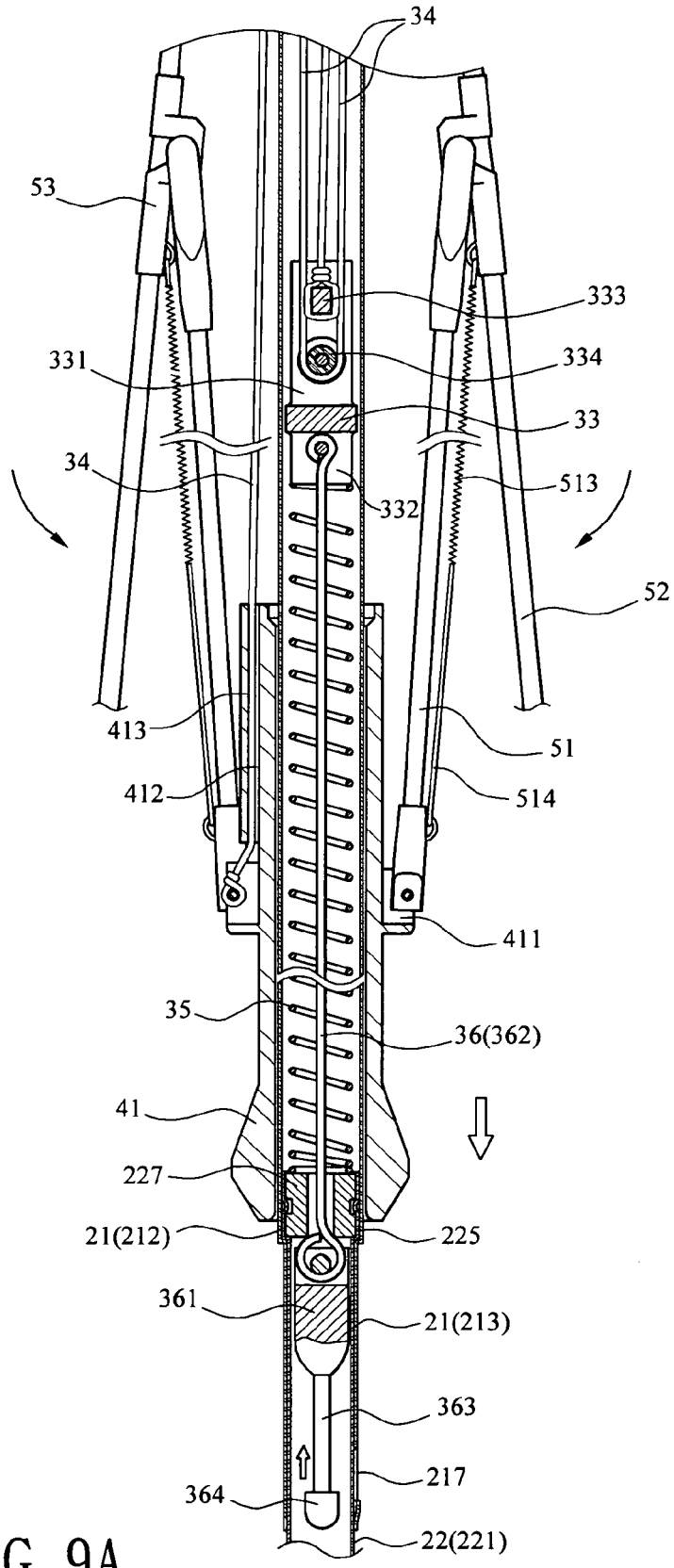
FIG. 9A is an enlarged view of the intermediate portion of FIG. 9.
Figure 12:
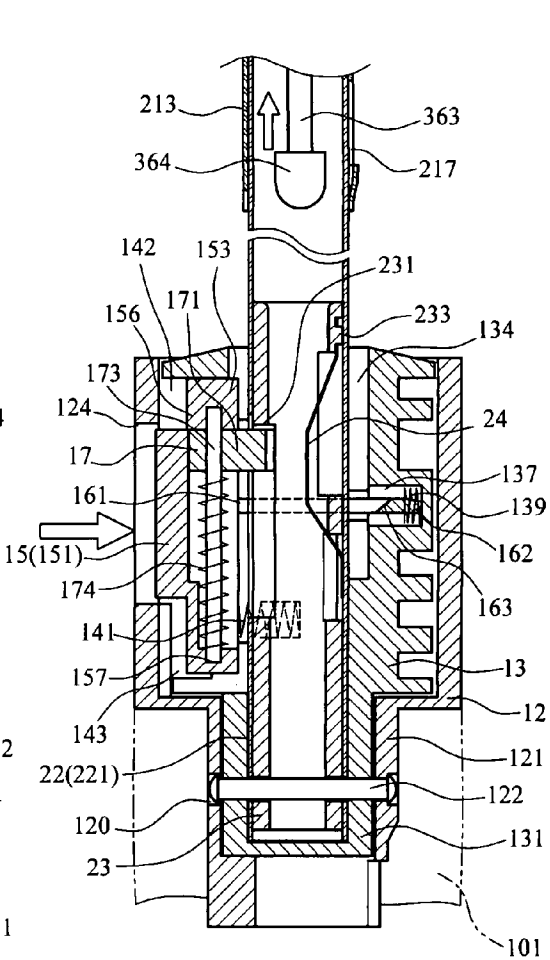
FIG. 12 is a view similar to FIG. 10 showing an umbrella closing operation.

As shown in FIGS. 6 and 7, the link assembly 30 is provided in the main section 221 of the first sliding tube 22 with the head 364 inserted into the second sliding tube 23 to be urged by the interconnection 242 of the resilient member 24 to lock in the window 231 of the second sliding tube 23. The first rod 362 inserts through the main section 221 of the first sliding tube 22 and the channel 228 of the plug 227.

Figure 15C:
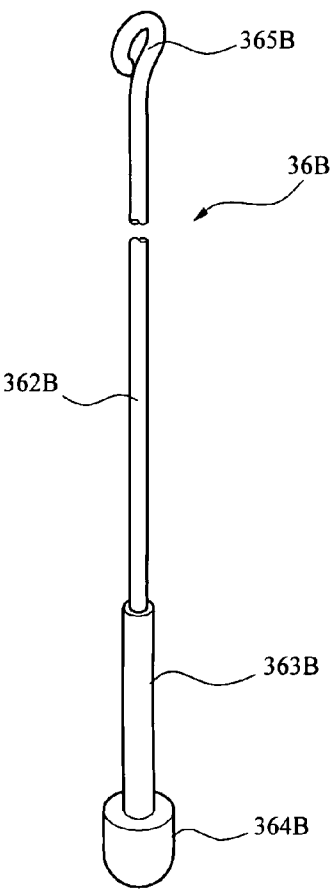
FIGS. 15A, 15B and 15C are perspective views of first, second and third configurations of the link respectively.
Figure 15B:
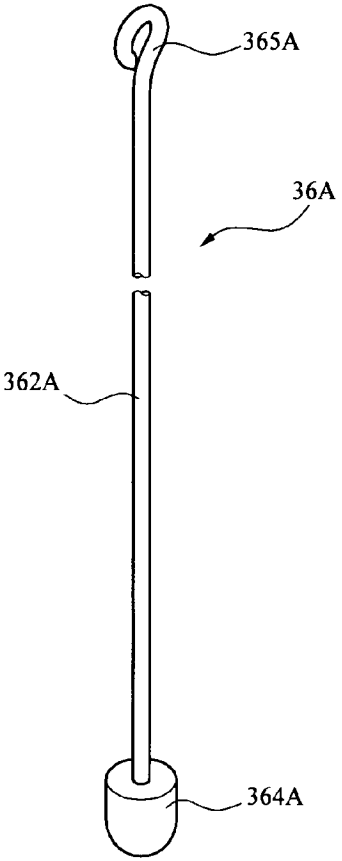
Figure 15A:
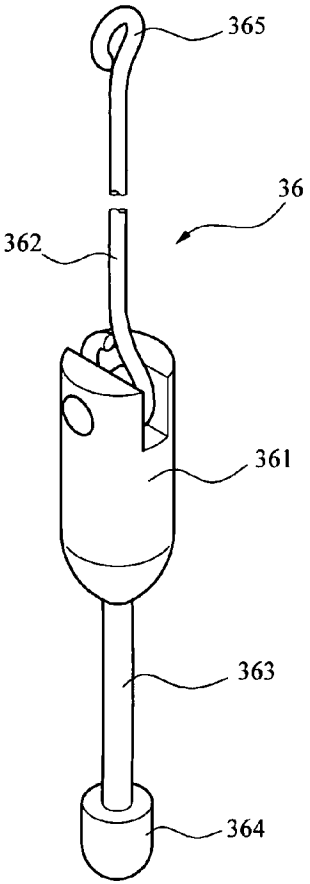

The connecting actuation block 361 may be provided as the one shown in FIG. 15A. Alternatively, the connecting actuation block 361 is eliminated and the link 36A comprises a hook 365A at one end, a head 364A at the other end, and a rod 362A interconnecting the hook 365A and the head 364A as shown in FIG. 15B. Still alternatively, the connecting actuation block 361 is eliminated and the link 36B comprises a hook 365B at one end, a head 364B at the other end, a first rod 362B, and a second rod 363B having a diameter larger than that of the first rod 362B. Both the rods 362, 363B are interconnected the hook 365A and the head 364A as shown in FIG. 15C.

The runner and top assembly 40 comprises a runner 41, a hub 42, a grommet 43, a ferrule 44, and a spring 45. The runner 41 is slidably provided on the cylindrical section 212 of the support tube 21 and comprises a plurality of slots 411 equally spaced around its intermediate portion, an upper tube (not numbered), a longitudinal guard 413 of L-section on the outer surface of the upper tube, a passage 412 defined by the guard 413, and an annular inner flange 414 proximate the mouth of the upper tube. The hub 42 is provided on the upper portion of the cylindrical section 212 of the support tube 21 and comprises a plurality of slots 421 equally spaced around its intermediate portion, a slit 422 on the outer surface of the upper portion of the hub 42 proximate the slots 421, a hole 423 above the slit 422, a threaded upper extension 424, a longitudinal groove 425 on the outer surface of the lower portion of the hub 42, and a pin 426 inserted through the hole 423 into the hole 214A to fasten the hub 42 and the cylindrical section 212 of the support tube 21 together.

The hollow grommet 43 comprises an upper extension 431 having threads 432 on its inner surface and an annular flange 433 on its outer surface in which the threads 432 are threadedly secured to the upper extension 424 to fasten the grommet 43 and the hub 42 together. The ferrule 44 has an annular groove 441 matingly secured to the flange 433 by snapping. As a result, the ferrule 44 and the grommet 43 are secured together. The spring 45 is put on the cylindrical section 212 of the support tube 21 and is biased between the flange 414 of the runner 41 and the bottom of the hub 42. Therefore, the runner 41 is adapted to move upward by compressing the spring 45.

The rope 34 passes around the sheave 322 and then passes the slit 422. Next, the rope 34 passes the passage 412 to have its one end fastened in one of the slots 411. Thus, pulling the rope 34 will lift the runner 41.

The rib and stretcher assembly 50 comprises a plurality of ribs 52 and a plurality of stretchers 51. The ribs 52 have one ends pivotably secured to the slits 421 and the other ends open as tips. A plurality of joints 53 are provided on the ribs 52 between the tips thereof and the hub 42. The stretcher 51 has one end pivotably secured to the joint 53 and the other end pivotably secured to one of the slots 411. A plurality of bars 514 are provided with one ends thereof pivotably secured to one ends of the stretchers 51. A plurality of springs 513 have one end secured to the other ends of the bars 514 and the other ends secured to the joints 53. An acute angle is formed between the stretcher 51 and the aligned spring 513 and the bar 514 thereunder. The length of the bar 514 and the spring 513 can decide force exerted upon each stretcher 51 when opening or closing the umbrella. Moreover, a canopy (not shown) is covered on the ribs 2 by stitching as known in the art.

As shown in FIG. 7, the umbrella in a closed condition is illustrated. The spring 35 is compressed between the lower seat 33 and the main section 221 of the first sliding tube 22. For opening the umbrella, simply pressing the push button 151 to push the press mechanism 15 rearward (see FIG. 10). Hence, the arms 161 are pushed by the press mechanism 15 to push the push member 16 rearward. As such, the second protrusion 163 clears the opening 217 so that the main section 221 of the first sliding tube 22 is adapted to slide. The head 364 is still locked in the window 231 of the second sliding tube 23 at this position. Thus, the lower seat 33 is motionless since it is connected to the link 36. The elastic force of the spring 35 will exert upon the main section 221 of the first sliding tube 22 and the plug 227. The main section 221 of the first sliding tube 22 is secured to the control block 13, the hollow cylinder 12 and the handle 101, and the main section 221 of the first sliding tube 22 is not locked by the second protrusion 163. As a result, the control block 13 and the main section 221 of the first sliding tube 22 are detached. Both the main section 221 of the first sliding tube 22 and the upper seat 32 slide upward. The rope 34 is pulled accordingly. Hence, the runner 41 moves upward because it is securely connected to the rope 34. The tips of the ribs 52 thus pivot away from the shank assembly 20 to open the umbrella because the joints 53 pivot away from the shank assembly 20. As an end, the umbrella is open automatically (see FIG. 8).

The spring 35 has a sufficient length. Also, the spring 35 has an elastic force much stronger than that of the springs 513. The lower section 213 of the support tube 21 is stopped by the sleeve 225 of the first sliding tube 22 after moving the cylindrical section 212 of the support tube 21 a predetermined distance. At this position, only a portion of the elastic force of the spring 35 is released and the springs 513 are slightly expanded. That is, the spring 35 is not fully expanded. The umbrella is thus fully open condition and the whole mechanism mentioned above is in a full balance condition.

Figure 11:
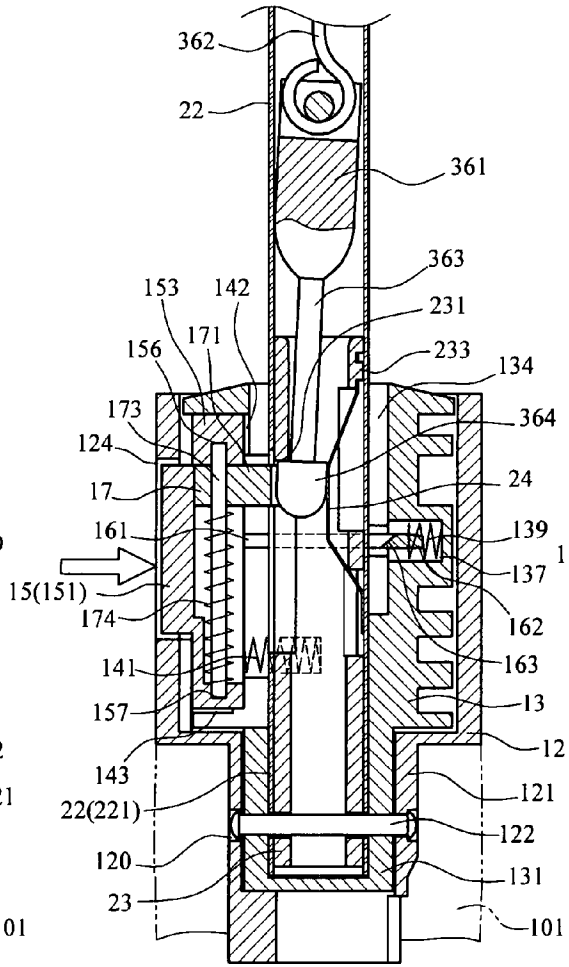
FIG. 11 is a view similar to FIG. 10 showing an umbrella closing operation.
Figure 10:
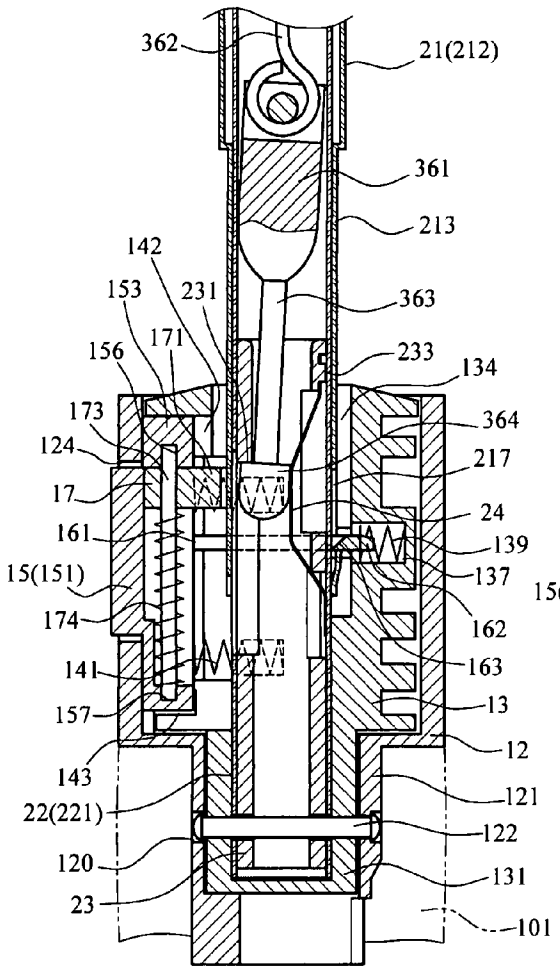
FIG. 10 is a longitudinal sectional view of the handle and actuation assembly in an inoperative condition.
Figure 14:
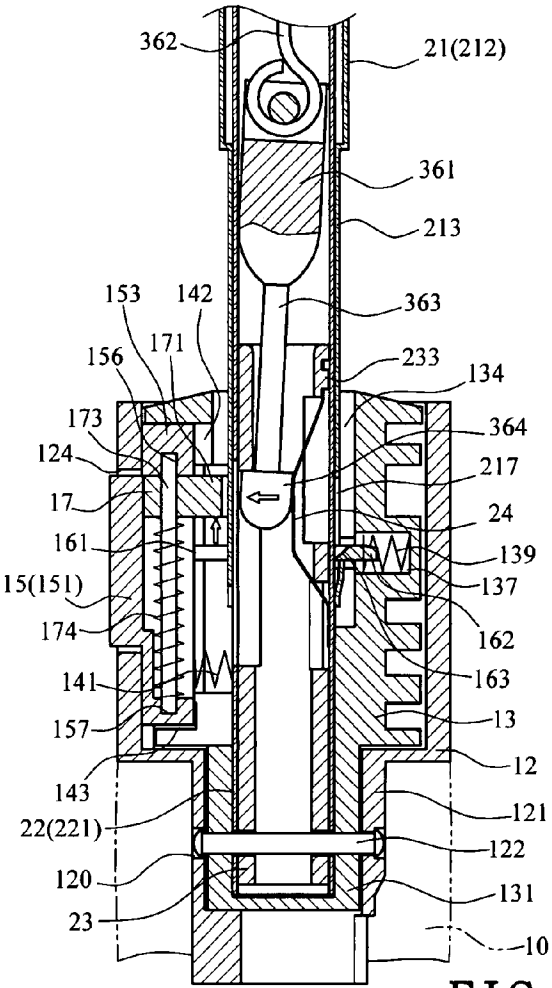
FIG. 14 is a view similar to FIG. 13 showing the elastic force storage operation being done.

As shown in FIG. 11, an umbrella closing operation is described. Pressing the push button 151 again will move the head 364 since the long part 171 of the actuation block 17 is not locked by the cylindrical section 212 of the support tube 21. That is, the elastic force of the resilient member 24 is overcome. Hence, the head 364 clears the window 231 of the second sliding tube 23 (see FIG. 12). Thereafter, the spring 35 releases its remaining elastic force to push the lower seat 33 upward (i.e., second step expansion). The outward pushing of the stretchers 51 by the rope 34 is stopped. The springs 513 thus compress to pivot the ribs 52 toward the shank assembly 20. At the same time, the runner 41 slides downward. As a result, the umbrella is closed (see FIG. 9). Also, the rope 34 is pulled down by the runner 41 to cause the rope 34 within the cylindrical section 212 of the support tube 21 to pull the upper seat 32 and the lower seat 33 together.

It is noted that umbrella opening involves releasing a portion of the elastic force of the spring 35 to push the main section 221 of the first sliding tube 22 upward by unlocking the control block 13 (i.e., first step elastic expansion). The spring 35 is adapted to completely release its remaining elastic force in a next closing operation (i.e., second step elastic expansion). Also, the springs 513 are compressed in the umbrella closing operation. That is, the springs 513 with small elastic force operate as auxiliary means of the spring 35 for closing the umbrella.

Figure 13:
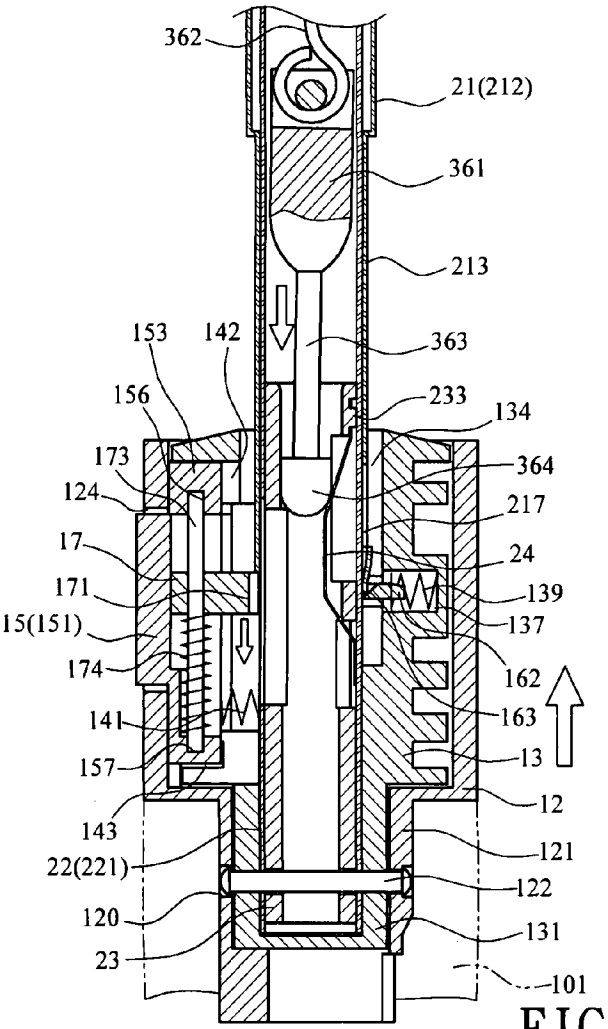
FIG. 13 is a view similar to FIG. 10 showing an elastic force storage operation of the shank spring after closing the umbrella.

As shown in FIG. 13, after closing the umbrella the elastic force storage operation (i.e., compression) of the spring 35 is illustrated. A person may hold the handle 101 to urge the ferrule 44 against, for example, the ground. Hence, the cylindrical section 212 of the support tube 21 is pressed to slide into the space 134 of the control block 13 until the second protrusion 163 of the push member 16 enters the opening 217 of the cylindrical section 212 of the support tube 21 to be locked. The movement of cylindrical section 212 of the support tube 21 causes the upper seat 32, the lower seat 33, and the link 36 to move together with the head 364 entered the space 341 of the control block 13 to urge against the window 231 of the second sliding tube 23 by the resilient member 24, i.e., the umbrella returning to its ready to use state (see FIG. 14). Further, the long part 171 of the actuation block 17 is pushed downward when the cylindrical section 212 of the support tube 21 enters the control block 13. Thereafter, the long part 171 of the actuation block 17 is lifted by the spring 174 to urge against the cylindrical section 212 of the support tube 21. As an end, the spring 35 is fully compressed and the head 364 is urged by the press mechanism 15 so that the umbrella can be opened again in a future use.

While the invention herein disclosed has been described by means of specific embodiments, numerous modifications and variations could be made thereto by those skilled in the art without departing from the scope and spirit of the invention set forth in the claims.

What is claimed is:

1. An umbrella comprising:

a control mechanism (11) comprising a hollow cylinder (12), a control block (13), a press mechanism (15), a U-shaped push member (16), and a T-shaped actuation block (17) wherein the cylinder (12) comprises a surface opening (124), the press mechanism (15) comprises a push button (151) disposed in the opening (124), the control block (13) is disposed in the cylinder (12) and comprises an axial space (134) and a surface opening (135) communicating with the space (134), the push member (16) is disposed in the space (134) and biased by a spring (139) to be aligned with the opening (135), the push member (16) comprising an inwardly projected first protrusion (162) with the spring (139) put thereon and an outwardly projected second protrusion (163) opposite the first protrusion (162), and the actuation block (17) is biased by a spring (174) thereunder;

a shank assembly (20) comprising a support tube (21), a first sliding tube (22), a second sliding tube (23), and a resilient member (24) wherein the support tube (21) comprises a cylindrical section (212) and a rear, lower opening (217), the first sliding tube (22) comprises a main section (221) slidably fitted in the cylindrical section (212) and secured to the control block (13), the main section (221) comprising a window (222), the second sliding tube (23) is slidably fitted in the main section (221) and comprises a window (231), and the resilient member (24) is disposed in the rear of the second sliding tube (23);

a link assembly (30) comprises a pulley mechanism (31), a spring (35), a rope (34), and a link (36) wherein the pulley mechanism (31) comprises an upper seat (32) with first and second sheaves (322, 323), the upper seat (32) being secured to the cylindrical section (212), a lower seat (33) with a third sheave (334), the rope (34) passes around the first, second, and third sheaves (322, 323, 334) to interconnect the upper and lower seats (32, 33), the spring (35) is put on the cylindrical section (212) and biased between the lower seat (33) and the cylindrical section (212), and the link (36) comprises a rod (362) connected to the lower seat (33), and a head (364) at one end of the rod (364), the head (364) being urged by the resilient member (24) to lock in the window (231);

a runner and top assembly (40) comprising a lower runner (41) slidably disposed on the cylindrical section (212) and comprising a plurality of slots (411) equally spaced around wherein one of the slots (411) is secured to the rope (34), and an upper hub (42) secured to an upper portion of the cylindrical section (212) and comprising a plurality of slots (421) equally spaced around; and a rib and stretcher assembly (50) comprising a plurality of ribs (52) having one end pivotably secured to the slit (421), a plurality of stretchers (51) having one end pivotably secured to a first intermediate portion of the rib (52) and the other end pivotably secured to the slot (411), and a plurality of springs (513) biased between the other end of the stretcher (51) and a second intermediate portion of the rib (52).

2. The umbrella of claim 1, wherein pressing the push button (151) will push the push member (16) rearward to cause the second protrusion (163) to clear the opening (217) so that the main section (221) is adapted to slide to partially expand the spring (35) which in turn exerts a force upon the main section (221) to unlock the main section (221) and disengage the control block (13) from the main section (221) so that both the main section (221) and the upper seat (32)

slide to pull the rope (34) which in turn moves the runner (41) upward to pivot the tips of the ribs (52) pivot away from the shank assembly (20), thereby opening the umbrella.

3. The umbrella of claim 1, wherein after opening the umbrella pressing the push button (151) will move the head (364) to clear the window (231) such that the spring (35) is adapted to fully expand to push the lower seat (33) upward, stop the rope (34) from outward pushing the stretchers (51), compress the springs (513) to pivot the ribs (52) toward the shank assembly (20), and slide the runner (41) downward, thereby closing the umbrella.

4. The umbrella of claim 1, wherein after closing the umbrella urging umbrella against a hard object will press and slide the cylindrical section (212) into the control block (13) until the second protrusion (163) enters the opening (217) to be locked, move the upper seat (32), the lower seat (33), and the link (36) together with the head (364) entered the control block (13) to urge against the window (231) by the resilient member (24), push the actuation block (17) to lift the actuation block (17) to urge against the cylindrical section (212), and urge the press mechanism (15) against the head (364) so as to fully compress the spring (35).

5. The umbrella of claim 1, wherein the cylinder (12) further comprises a guide projection (126) on the inner surface proximate the bottom of the opening (124), and two opposite raised guiding wedges (125) on the inner surface with the guide projection (126) disposed therebetween;

the control block (13) further comprises two opposite flats (133) on the outer surface, a U-shaped groove (136) aligned with the opening (135) for mounting the U-shaped push member (16) therein, at least one spring receptacle (140), and a cavity (137) on the blind end of the groove (136), a first recess (142) on the top of the opening (135), and a second recess (143) on the bottom of the opening (135); and the second protrusion (163) is of triangular section.

6. The umbrella of claim 1, wherein the press mechanism (15) further comprises a rear press plate (152) aligned with the opening (135), a top riser (153) slidably disposed in the first recess (142), a bottom riser (154) slidably disposed in the second recess (143), a central, longitudinal trough (158) on the bottom riser (154) with the guide projection (126) slidably disposed therein, a well (155) on the rear of the press plate (152) with the actuation block (17) disposed therein, and first and second apertures (156, 157) on the top and bottom edges of the well (155) respectively.

7. The umbrella of claim 6, wherein the actuation block (17) comprises a long part (171) having an arcuate end, a longitudinal pin (173) having both ends fastened in the first and second apertures (156, 157) and passing the actuation block (17), and a spring (174) put on the pin (173) to be biased between the bottom of the well (155) and the actuation block (17).

8. The umbrella of claim 1, wherein the support tube (21) further comprises an upper window (214) on the cylindrical section (212), and a lower section (213) shorter than the cylindrical section (212), the lower section (213) of multiple side surfaces having a rear opening (217); and the main section (221) of multiple side surfaces is adapted to slidably fit in the lower section (213), the main section (221) further comprises a sleeve (225) of circular section disposed on the top of the main section (221), and a plug (227) disposed in the sleeve (225) and having an axial channel (228) with the rod (361) passing through.

9. The umbrella of claim 1, wherein the second sliding tube (23) is shaped to have multiple side surfaces and further comprises a window (232) in the rear of the window (231) for positioning the resilient member (24), and a protrusion (233) above the top of the window (232); and the resilient member (24) is bent and comprises an upper flat (243) having a hole (244) put on the protrusion (233), a lower flat (241) urged against a portion of the second sliding tube (23) below the second window (232), and a curved interconnection (242) projecting through the window (232) into the second sliding tube (23).

10. The umbrella of claim 1, wherein the upper seat (32) further comprises a longitudinal groove (321) with the first and second sheaves (322, 323) disposed therein;

the lower seat (33) further comprises an upper cut (331), a lower cut (332), and a weight (333) disposed in the upper cut (331); and the rod (362) comprises a lower extension (363).

11. The umbrella of claim 1, wherein the runner and top assembly (40) further comprises a grommet (43); and the runner (41) further comprises a longitudinal guard (413) of L-section on the outer surface terminating at the slot (411) for defining a passage (412), and an annular inner flange (414) proximate the top of the runner (41).

12. The umbrella of claim 1, wherein the hub (42) further comprises a threaded upper extension (424);

the grommet (43) comprises an upper extension (431) having internal threads (432) secured to the upper extension (424); and the runner and top assembly (40) further comprises a ferrule (44) secured onto the upper extension (431), and a spring (45) put on the cylindrical section (212) and biased between the runner (41) and the hub (42).

13. The umbrella of claim 1, wherein the rib and stretcher assembly (50) further comprises a plurality of joints (53) disposed on the first intermediate portion of the rib (52), the joints (53) being connected to the other ends of the springs (513); and a plurality of bars (514) having one ends pivotably secured to one ends of the stretchers (51) and the other ends secured to one ends of the spring (513), and wherein an acute angle is formed between the stretcher (51) and the aligned spring (513) and the bar (514) thereunder.

* * * * *